United States Patent [19]

Nickell

[11] Patent Number: 4,989,798

[45] Date of Patent: Feb. 5, 1991

[54] HIGH SPEED PRECISION YARN WINDING SYSTEM

[75] Inventor: Larry C. Nickell, Lewisburg, W. Va.

[73] Assignee: Appalachian Electronic Instruments, Inc., Ronceverte, W. Va.

[21] Appl. No.: 458,420

[22] Filed: Dec. 14, 1989

Related U.S. Application Data

[60] Division of Ser. No. 432,663, Nov. 7, 1989, which is a continuation-in-part of Ser. No. 270,813, Nov. 7, 1988, abandoned.

[51] Int. Cl.[5] ..... B65H 54/02; B65H 54/28

[52] U.S. Cl. ..... 242/18 R; 242/18 DD; 242/43 R; 242/43 R; 242/45

[58] Field of Search ..... 242/18 R, 18 DD, 43 R, 242/43 A, 43.1, 45

[56] References Cited

U.S. PATENT DOCUMENTS

| | | | |
|---|---|---|---|
| 2,463,773 | 3/1949 | Jencks | 242/18 R |
| 2,466,109 | 4/1949 | Jencks | 242/18 R |
| 2,972,450 | 2/1961 | Brierley | 242/18 R |
| 3,490,709 | 1/1970 | Siegenthaler | 242/43 A X |
| 3,617,009 | 11/1971 | Lawson | 242/18 R |
| 3,823,886 | 7/1974 | Siegenthaler | 242/43.1 |
| 4,106,710 | 8/1978 | Schippers et al. | 242/18 R |
| 4,245,794 | 1/1981 | Hasegawa et al. | 242/45 |
| 4,349,160 | 9/1982 | Niederer | 242/18 R |
| 4,561,603 | 12/1985 | Schippers et al. | 242/43 A |

FOREIGN PATENT DOCUMENTS 448835 4/1968 Switzerland .

*Primary Examiner*—Stanley N. Gilreath

*Attorney, Agent, or Firm*—Mason, Fenwick & Lawrence

[57] ABSTRACT

A high-speed precision winder for winding a running yarn onto a package tube to form a cross wound yarn package, including a spindle for rotating the tube about a spindle axis, a yarn traversing mechanism for guiding running yarn received along an infeed path back and forth across a traverse zone, a bail roll disposed in rolling contact with the peripheral surface of the yarn package being wound, apparatus for controlling tension of the infeed yarn, and a control system for continuously regulating operation of the winder during formation of the package. The control system includes three separate variable speed drive motors and respective associated motor control circuits forming a spindle drive, a traversing means drive, and a down pressure drive providing three independent motor systems which are separately controllable. A load cell structure is associated with the bail roll and output signals from the load cell and predetermined set processing condition data applied to a microprocessor provide control signals to activate the motors to control the relative positions of the bail roll and package tube and regulate the spindle drive and traversing mechanism drive to maintain a desired yarn density and tension throughout winding of the package.

16 Claims, 13 Drawing Sheets

68
69
70
69
64
57
59
61
43
50a
50b
56
67
66
53
51
54

HIGH SPEED PRECISION YARN WINDING SYSTEM

PRIOR RELATED APPLICATIONS

The present application is a division of application Ser. No. 432,663 filed Nov. 7, 1989, which is a continuation-in-part of my earlier application Ser. No. 270,813, filed Nov. 7, 1988 now abandoned.

BACKGROUND AND OBJECTS OF THE INVENTION

The present invention relates in general to the winding of textile yarns, filaments, or the like of natural, man made or synthetic materials, all referred to herein as "yarns", and more particularly to high speed precision winding of yarn packages on a precision winder machine having a propeller structure for guiding the yarn back and forth between the ends of the package during the winding process, and incorporating sensors and controls for regulating the propeller drive, the spindle drive for the yarn package, and down pressure drive to produce a highly uniform package which is free of ribboning effects when subjected to dying processes and the like.

Before the days of the continuous filament extrusion, texturizing, and similar high speed methods of yarn production, traditional traversing mechanisms for laying yarn on a package included a grooved scroll which either engaged the yarn directly or drove a yarn guide so as to cause it to carry out a reciprocatory traversing motion. Those mechanisms were limited as to their speed of operation and the uniformity of packages produced by such mechanisms.

Upon the more recent development of high speed yarn production methods, the demand was emphasized for winders having very much higher speeds of operation. One form of traversing mechanism proposed for such high speed winders included slot like yarn guides mounted on closely spaced driving members moving in opposite directions across the traverse so that the yarn was carried from one end of the traverse to the other by one yarn guide and was then transferred to another yarn guide so as to be carried back in opposite direction. This avoided inertial problems which were incident to use of a single yarn guide which moved in one direction and then the other, but created problems of yarn transfer from one guide to another.

While driving arrangements involving two guide members, one moving in one direction and the other in the opposite direction, have taken forms such as belt or chain drives for the yarn guides moving them in a straight line across the traverse, the use of rotary discs or blades which act as yarn guides moving across the traverse along and arc of a circle have come into wide use. These rotary discs or blade type yarn guides move in a continuous path with no abrupt changes in velocity or direction, so that the only inertia concerns presented are in connection with the inertia of the yarn itself at each reversal point. Care had to be taken, however, to maintain close control of the yarn as it is transferred from one yarn guiding blade or disc to another, in a manner which would avoid nipping action on yarn which may have an adverse effect on its quality. However full control over the yarn during transfer from one driving member to another is essential.

One of the widely used types of cross winding systems employed in the textile industry is of the type disclosed in U.S. Pat. No. 3,823,886 granted to Maschinenfabrik Scharer, which involve first and second yarn guides of a propeller or blade type rotatable and opposite directions about respective axes of rotation which are offset from each other, associated with respective substantially circular shaped guide members provided for each of the yarn guides, centered on the respective axes of rotation of the yarn guides so that the guide tracts intersect each other at a pair of diametrically opposite points for overlapping of the thread guides at these points. Other yarn traversing apparatus of this general type involving rotary blade or propeller type guides are disclosed in U.S. Pat. No. 4,561,603 of Dec. 31, 1985, U.S. Pat. No. 4,585,181 of Apr. 29, 1986 and U.S. Pat. No. 4,646,983 of Mar. 3, 1987 all granted to Barmag Barmer Maschinenfabrik A.G.

It has been customary, heretofore, for example in the Scharer winder machines, to attempt control of the winding in an effort to achieve uniformity throughout the wound packages by regulating a drive motor which drives the yarn guide blades or propellers and the package spindle. However, it has been found that this arrangement does not provide sufficient control of the various parameters affecting uniformity of the density of the yarn package to achieve the desired extent of yarn package uniformity wherein the packages are free of ribboning when subjected to the dying process, and which would have such uniformity all the way to the bottom of the package so that the innermost layers of yarn do not need to be discarded. I have found, however, that by providing separate drive motors providing separately controlled drive systems for the spindle drive, the propeller drive, and a down pressure drive, thus providing three independent motor systems that can be separately controlled, one can properly set and regulate the pitch and the tension during winding of the package so as to maintain the desirable yarn density or tension throughout the whole package, and ensures freedom from development of ribboning patterns during package winding, which are detrimental during the dying process.

DETAILED DESCRIPTION OF A PREFERRED EMBODIMENT

Figure 1:
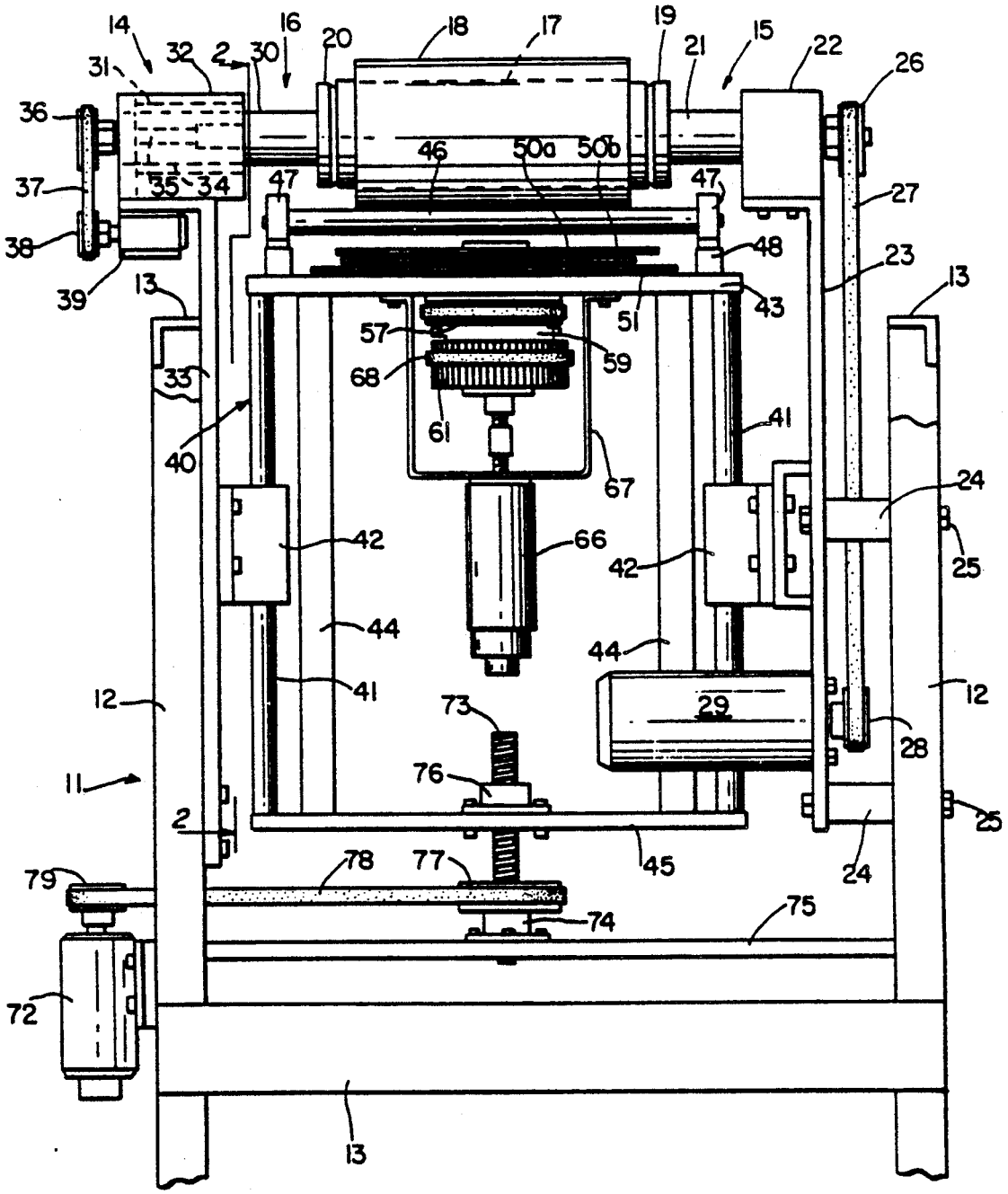
FIG. 1 is a front elevational view of the yarn winding apparatus of the present invention, showing the portions of the frame associated with the components related to production of the yarn package, with lower portions of the frame not shown.
Figure 3:
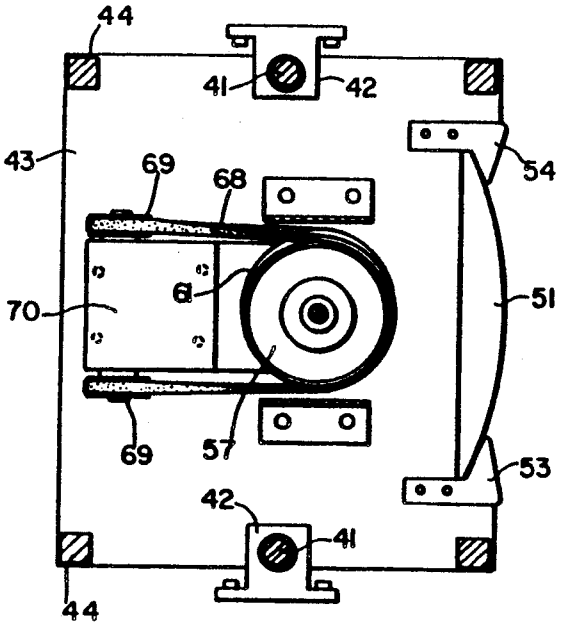
FIG. 3 is a horizontal section view showing the underside of the moveable platform supporting the yarn guide propeller members and the drive therefor, taken along the line 3—3 of FIG. 2.
Figure 2:
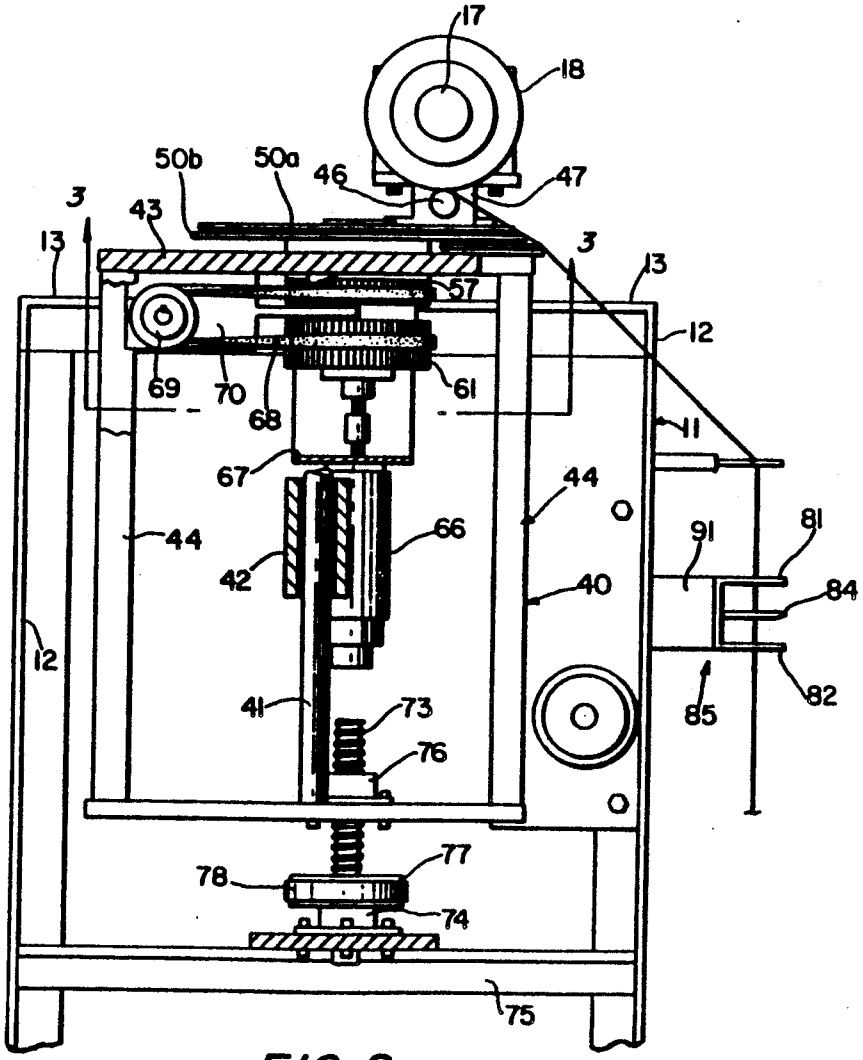
FIG. 2 is a vertical section view of the apparatus, taken along the line 2—2 of FIG. 1.

Referring to the drawings, wherein like reference characters designate corresponding parts throughout the several figures, and particularly to FIGS. 1 and 2, the high speed precision yarn winding apparatus of the present invention is indicated generally by the reference character 10 and comprises, in one preferred embodiment, a supporting frame 11 formed basically of angle iron members, including vertical main frame members 12, and horizonal frame members 13 extending between and fixed to the vertical frame members 12. Near the upper end portion of the main frame 11 is a yarn package support assembly, indicated at generally at 14, comprising a driven tube-engaging head subassembly 15 and an axially moveable companion head assembly 16 providing a live center for the yarn package tube 17 on which the yarn package 18 is to be wound. The head assemblies 15 and 16 each include a truncated conical head 19 and 20, respectively adapted to partially interfit into the hollow center of the yarn package tube 17 and embrace the tube 17 and yarn package 18 therebetween. The driven head 19 is fixed on a cylindrical spindle 21 journaled in the bearing block 22 fixed on a support arm 23 carried by the stationary main frame 11, for example by spacer members 24 and bolts 25 connected to upright main frame members 12 at one side of the main frame or to horizontal cross members extending therebetween. The end of the spindle 21 opposite the drive head 19 projects from the bearing block 22 and carries a pulley 26 driven by a belt 27 trained about the pulley 26 and about an output drive pulley 28 on the output shaft of the spindle drive motor 29. The spindle drive motor 29 may be conveniently supported also from the support arm 23.

The opposite or live center head 20 forms a removable holder for the yarn package tube 17 and is rotatably supported on a retractable and returnable spindle member 30, for example by roller bearings, rotatably supporting a truncated conical tube holder head 20 on the spindle member 30. The spindle member 30 is supported for axially movement between an extended, tube holding position as illustrated in FIG. 1, to a retracted tube removal position in a linear slide sleeve 31 housed in a supporting block 32 carried by another support arm 33 extending from the main frame 11, the spindle member 30 having an internal nut 34 threaded on a screw shaft 35 which projects from the support block 32 on the side opposite the tube holder head 20. A pulley 36 is provided on the screw shaft 35, driven through a belt 37 trained about a drive pulley 38 on the output shaft of a DC motor 39 operating in a constant torque mode and forming a doff motor for retracting or doffing a fully wound package 18 and its associated tube 17 when the package is fully wound. Energizing of the doff motor 39 effects rotation of the screw shaft 35 through the system of pulleys 38, 36 and belt 37, causing the nut 34 carried by the spindle member 30 to be driven by the threads on the screw shaft 35 in a direction to axially retract the spindle member 30 and tube holder head 20 through a travel of about 1½ inches, withdrawing the live center tube holder head 20 from holding relation to the tube, permitting tube 17 and package 18 to be doffed or withdrawn. A new empty yarn package tube 17 is replaced by fitting one end of the new empty tube 17 on the companion tube holder head 19 and activating the doff motor 39 to rotate the screw shaft 35 and axially drive the spindle member 30 in tube holder head 20 through a return stroke to the tube holding position shown in FIG. 1.

A movable subframe 40 is guided for vertical up and down movement in the main frame 11 between the vertical frame members 12, for example, by vertical guide rods 41 sliding in guide sleeves or brackets 42 fixed to appropriate portions of the main frame 11. The vertically movable subframe 40 comprises a bail roll and yarn guide propeller supporting upper platform 43 at the uppermost end of the subframe 40, connected by vertical subframe members 44 with a bottom horizontal subframe member 45 to form a unitary movable subframe which can be raised and lowered as required as the yarn package 18 is being formed on the tube 17. The upper platform 43 supports a bail roll 46 supported in bearing brackets 47 at its opposite ends, at least one of which is carried on a load cell 48 mounted on the uppermost surface of the platform 43 and disposed between the upwardly facing surface of the platform 43 and the bottom surfaces of the bail roll bearing brackets 47. The mounting of the bail roll 46 on load cell 48 and the processing circuitry associated with the output signals from these load cells provides a down pressure sensing and control system, as later described in greater detail, to maintain proper down pressure properties responsive to pressure of the package on the bail roll and causing the platform 43 to be raised and lowered relative to the spindle axis to maintain proper package winding. The load cell 48 may be of the kind marketed by Transducer Techniques, Inc. of Rancho, Calif., described as low profile load cells, which incorporate strain gauge transducers providing an output signal proportional to the load on a member, which in this case is the bail roll 46. This produces a highly accurate and reliable signal output indicative of the down pressure of the yarn package on the bail roll, by providing a beam structure or the like having suitable mounting surfaces for a plurality of electrical strain gauges and utilizing the transducive electrical strain gauges to measure the shear stresses caused by the applied loads. The transducive effect of a strain gauge allows for accurate translation between a given amount of stress imposed on a surface by a load and its electrical equivalent, resulting in an accurate stress measurement. Foil, semiconductor, or other types of strain gauges may be effectively used to provide such shear stress measurements. Typically, the strain gauges are connected into a Wheatstone bridge network to provide the correct output. The principals of the strain gauge employed may be similar to those disclosed in earlier U.S. Pat. Nos. 3,927,560 and 4,127,001, as typical examples.

Figure 4:
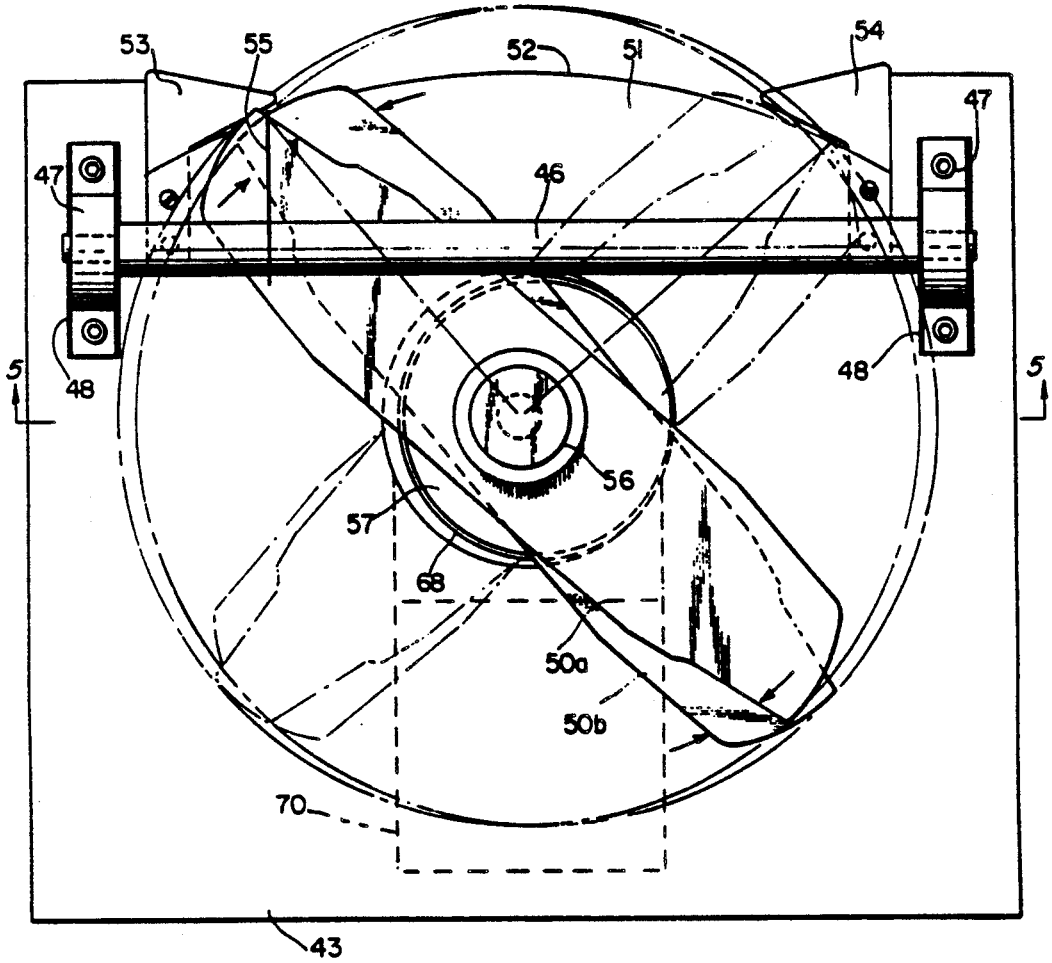
FIG. 4 is a top plan view of the propeller supporting platform, the yarn guide propellers and associated stationary guide members, and the bail roll and supports therefor.

Also mounted on the vertical translation platform 43 of the movable subframe 40 is a pair of yarn guide blades or propellers **50*a*, 50*b* rotating in opposite directions through appropriate paths immediately above the curved yarn guide bar 51 fixed to the vertical translation platform 43 and having a convexly curved working edge 52, spanning a yarn traversing zone of appropriate width between a pair of end control guide rails 53, 54. As will be well understood by persons skilled in the relevant art, the yarn guide propeller blades 50*a*, 50*b* and the stationary yarn guide bar 51 and end control guide rails 53, 54, form a yarn winding station whereby the uppermost yarn guiding propeller and blade 50*a*, as best shown in FIG. 4, traverses the yarn, indicated at 55, from top to bottom (as shown in FIG. 4) or from right to left as viewed in FIG. 1, along the length of the package 18 and, after transfer to the guide propeller or blade 50*b* while the yarn is captured against outward disengaging movement from the blade system by the end control guide rail 54, at the lower or left and end of the field of traverse, the yarn 55 is traversed back again to the upper or right hand end where it is again transferred back to the yarn guide propeller or blade 50*a***.

The driving mechanism for the yarn guide propellers or blades **50*a*, 50*b* comprises a propeller shaft 56 supported for rotation in a vertical axis, which is fixed to the uppermost blade or propeller 50*a* and extends through a center opening in the lower blade or propeller 50*b*. The lower blade or propeller 50*b* is fixed to an upper pulley member 57, in the form of a downwardly opening cup or hollow cylinder, having a center collar portion 57*a* encircled by roller bearing assemblies 58 whose outer portions are supported in an extension 59*a* of a bearing housing 59, the lower portion of which supports the outer portion of the roller bearing assembly 60 encircling and mounted on the center post or spindle portion 61*a* of the lower pulley 61. The bearing assemblies 58, 60 are captured in the bearing housing 59 by retainer rings 62 and the center opening 57*b* in the center collar portion 57*a* of the upper pulley 57 is of a sufficiently large diameter to accommodate rotation of the upper pulley 57 about an eccentric axis A2 located eccentrically relative to the vertical axis A1 which extends through the centers of the propeller shaft 56 and the lower pulley 61. The lower end of the propeller shaft 56 driving the upper propeller or blade 50*a* is fixed against relative rotation in the socket formation in the spindle or center post portion 61*a* of the lower pulley 61, and the pulley 61 is coupled by a locking ring 63 and a lock nut 64 to the drive shaft 65 of the propeller or blade drive motor 66. The motor 66 is mounted by a suitable hanger bracket 67 depending from the platform 43, with its vertical legs spaced outwardly from the peripheries of the eccentrically related upper and lower pulleys 57, 61. The outer surfaces of the cylindrical pulleys 57, 58 are provided with teeth interfitted with tooth formations on the toothed endless belt 68 which is trained about the lower pulley 61, driven directly from the output shaft of the propeller drive motor 66, the belt system being arranged to effect rotary drive of the upper pulley 57 in a reverse direction. This is accomplished by training the belt 68 about an idler roll or pair of idler pulleys on an interconnecting shaft, shown at 69, journaled for rotation in a mounting block 70 and protruding from both ends thereof providing end portions about which the belt is wrapped, with the upper portion of the belt in a horizontal path immediately above the idler roll 69 extending about and interfitting with the teeth on the outer periphery of the upper pulley 57**.

The entire subframe assembly 40 is movable upwardly and downwardly responsive to down pressure signals derived from the bail roll 46 and load cells 48, and the associated circuitry, activating a down pressure control motor or platform positioning motor 72 mounted on the main frame 11. Vertical movement of the subframe 40 and the vertical translation platform 43 is achieved, in a preferred example, by an Acme screw and nut assembly, as indicated by the vertical lag screw 73 journaled for rotation at its lower end in a bearing bracket 74 carried by a horizontal stationary beam 75 fixed to and forming part of the main frame 11 and extending through the nut 76 carried by the lower cross frame member 45 of the vertically movable subframe 40. The Acme screw 73 is driven by a pulley 77 fixed against relative rotation on the drive screw 73, as by keying the pulley to the drive screw, driven by a belt 78 trained about the pulley 77 and about drive pulley 79 fixed to the output shaft of the down pressure control motor 72.

It will be apparent from the above description that this apparatus, therefore, provides three motors providing separate control of three principal factors determining the precision winding of the yarn package so as to provide the desired level of uniformity and absence of ribboning. First the down pressure control motor 72 controls the vertical position of the vertical translation platform 43 carrying the yarn guide propellers or blades **50*a*, 50*b* and associated yarn guide structure, as well as carrying the bail roll 46 and its associated load cells 48. Secondly, the propeller drive motor 66 carried by the vertically movable platform 43 determines the speed of drive of the yarn guide propellers or blades 50*a*, 50*b* and thus the speed of traverse of the yarn between the opposite ends of the package being formed. Thirdly, the spindle drive motor 29 carried by the stationary main frame 11 drives the spindle 21 and tube holder head 19 to rotate the yarn package tube 17** and thus determine the speed of winding of yarn onto the package.

Control of the spindle drive motor 29 is derived from the yarn tensioner assembly, indicated generally at 80, to sense the tension of incoming yarn leading to the winder and provide load cell output signals which are processed to effect yarn drive so as to maintain a predetermined yarn tension and preserve uniformity of winding and tracking of the yarn on the package. Alternatively, the owner has the option of having a constant speed drive for the spindle motor 29 instead of a control system which is responsive to sensing of incoming yarn tension.

Figure 7:
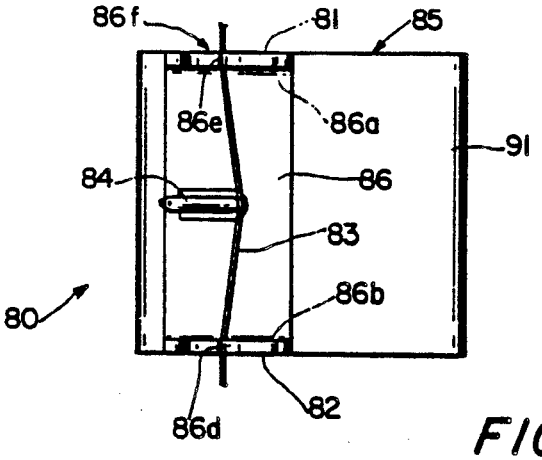
FIG. 7 is a fragmentary front view showing one form of yarn tensioner mechanism for the apparatus.
Figure 8:
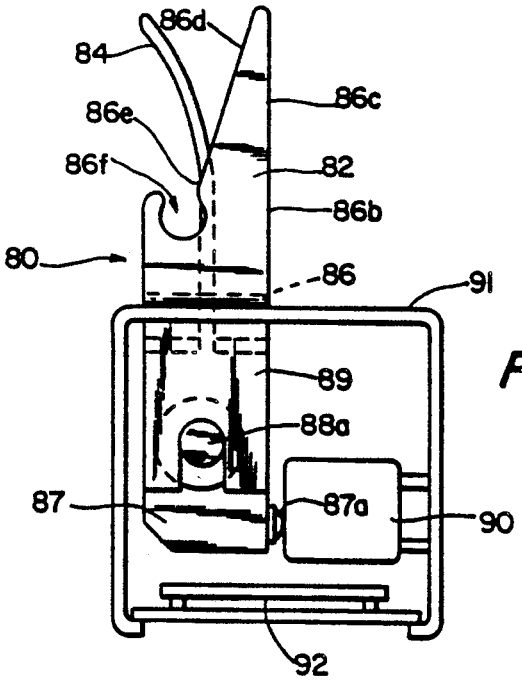
FIG. 8 is a side elevational view of the yarn tensioner.
Figure 9:
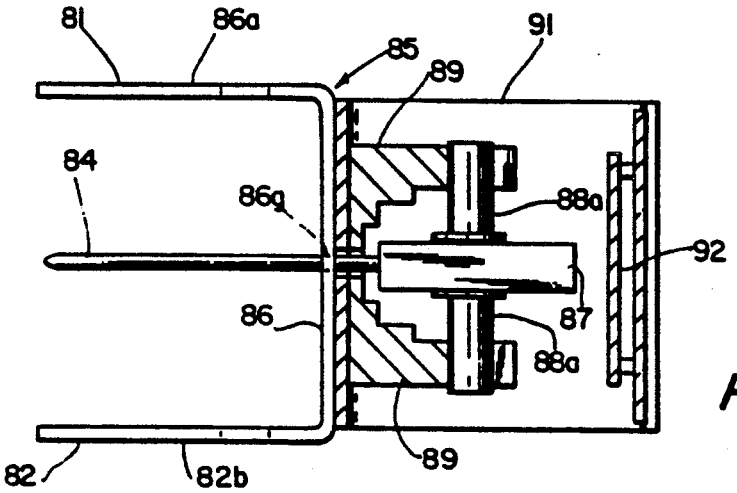
FIG. 9 is a horizontal section view taken along line 9—9 of FIG. 8.

Referring particularly to FIGS. 7–9, there is shown in those figures one preferred embodiment of the yarn tensioner assembly 80 which, in general may be described as forming a pair of yarn guides 81, 82 which are vertically spaced along the yarn feed path 83, with a sensor arm 84 interposed therebetween bearing against the yarn and deflecting it slightly out of the yarn path defined by the eyes in the yarn guides 81, 82. In this yarn tensioner, the guides 81, 82 are formed as a pair of parallel legs bent from a plate to form a U-shaped bracket 85 having a transverse base portion 86 and outwardly bent legs **86*a*, 86*d* defining the guides 81, 82. The legs 86*a*, 86*b* include a projecting finger portion 86*c* having an inclined surface 86*d* forming one side of a truncated triangular hook portion of the finger which leads through a throat formation 86*e* into a generally circular or rounded eye formation 86*f* which receives the yarn and defines the yarn path 83 between the two guides 81, 82. The eye formation 86*f* should be deep enough to prevent yarn escape while running at high speeds, and the inclined surface 86*d* of the finger portion 86*c* is so positioned and shaped that the yarn will self thread from this surface into the eye formation 86*f*. The transverse base portion 86 is provided with a slot 86*g* at its center elongated widthwise of the base portion 86 and receiving the sensor arm 84, which is in the form of a bent rod, for example a ceramic flame coated stainless steel rod having an outer diameter of about ⅛th inch, extending from a block 87 having bearings 88 pivoting the block on a pivot shaft 88*a* extending between stationary support arms 89. The block 87 includes a protruding finger formation 87*a* bearing against a load cell 90 supported by mounting standoffs or a block from the support plate which also supports the arms or yoke 89 mounting the pivot shaft 88*a* thereto as well as supporting the U-shaped bracket 85 forming the guides 81, 82. In practice, this support plate, indicated at 91, which must also be provided with a slot for appropriate movement of the yarn contacting feeler 84, may be bent in a U-shaped as shown in the drawings to support a printed circuit board amplifier and carrier plate 92 for amplifying signals from the load cell 90**.

Figure 11:
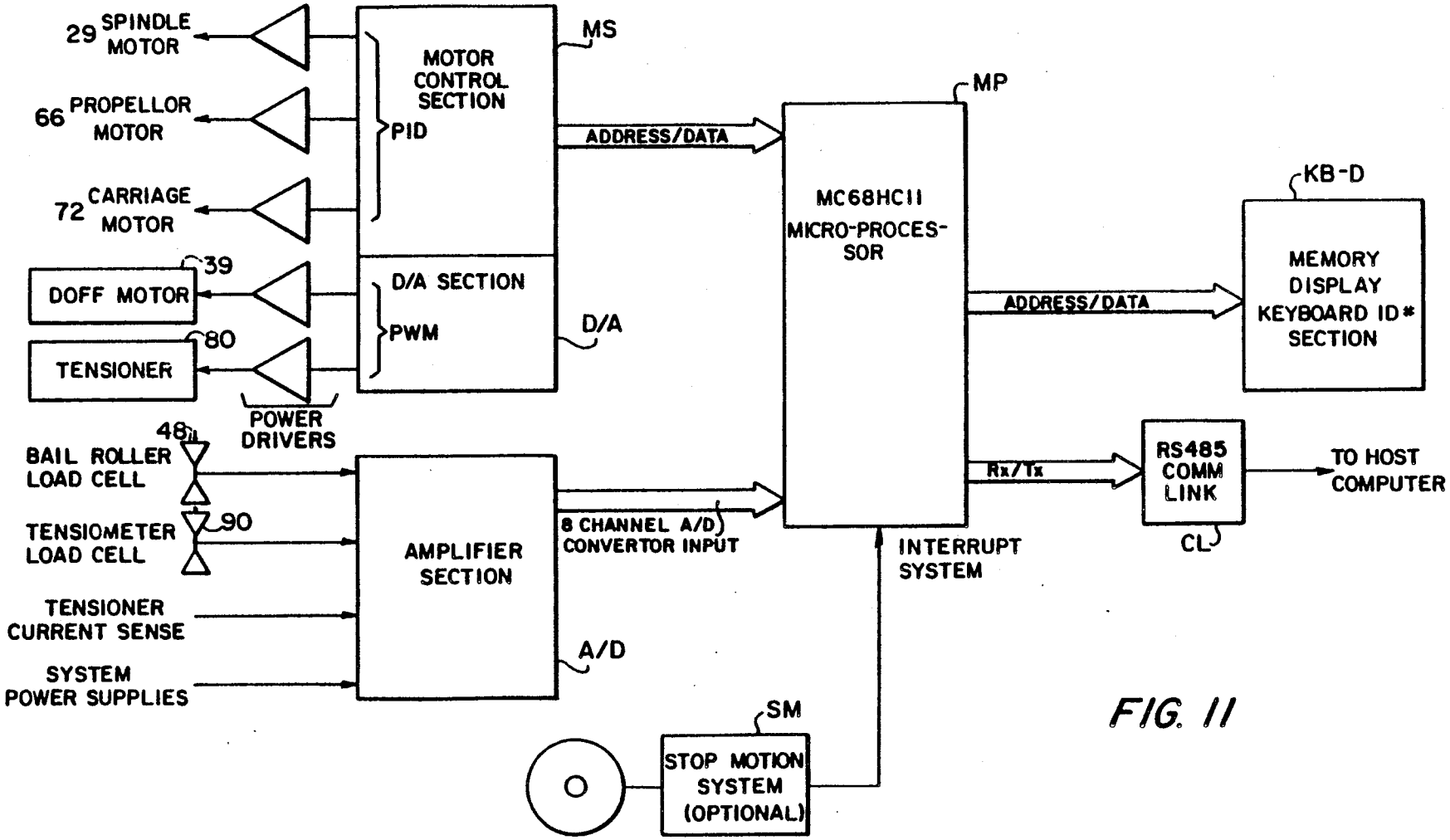
FIG. 11 is a block diagram of the control system for the winder.

A preferred example of a winder control system for the high speed precision winder of the present invention is indicated in block diagram form in FIG. 11, wherein the control system is shown as including a motor section MS, a digital to analog section indicated at D/A, and an analog to digital section, indicated at A/D, which are connected to a microprocessor indicated at MP. To describe the overall operation, the microprocessor MP writes command data to the digital proportional, Integral, Derivative (PID) control subsystem. This command data determines the speed, acceleration, and servo response characteristics of each of the three motors, namely the spindle drive motor 29, the propeller or blade drive motor 66, and the carriage positioning or down pressure control motor 72. The resolution of each controller is one in 4,294,967,296 or 32 bits. Consequently, highly precise speed ratios between the spindle motor and the propeller may be achieved. This control technique also allows for the DC motors 29, 66, and 72 to be operated in a position mode. This is advantageous for the carriage system 40 controlled by the carriage motor 72, as the microprocessor is positioning the carriage 40 and platform 43 in response to pressure on the yarn package 18 as measured by the load cell or load cells 48 associated with the bail roll 46. The circuit associated with the load cell 48, to be later described, sends a signal to the microprocessor MP proportional to the pressure on the package. If this value is greater than the programed set point, the microprocessor MP lowers the carriage position of carriage 40 and platform 43 until the setpoint value is received from the load cell 48. The carriage motor 72 is then commanded to halt.

The Digital to Analog subsystem D/A includes two converters, to which the microprocessor MP writes data to establish set points for tensioner current to the tensioner assembly 80 and doff motor current to the doff motor 39. The D/A output controls the duty cycle of a pulse width modulated (PWM) power stage. This duty cycle may be varied from 0 to 100%. Consequently, the tensioner current and doff motor current may be varied from 0 to 100%. The tension or current is directly proportional to the amplified yarn tension developed by an electromagnetic tensioning device. The doff motor current for the motor 39 is directly proportional to the force exerted on the dye tube 17 by the live center system (the live center tube holder head 20).

Referring to the Analog to Digital system A/D, the microprocessor MP monitors a variety of analog values in the winder system to maintain system parameters, efficiency, and diagnostics capability. The three system parameters monitored are (1) the down pressure load cell 48 to establish current pressures, (2) the tensioner current which establishes that the tensioner is functional and that the value is sufficient for the tensiometer to maintain control and (3) the tensiometer load cell 90 which transmits the current yarn tension to the microprocessor. The other five A/D inputs to the Analog to Digital subsystem A/D are used to monitor system power supplies and motor currents for fail safe operation and diagnostic functions.

Also shown in the block diagram of FIG. 11 as part of the overall winder control system is a stop motion system indicated at SM, providing a means to determine if the yarn from the supply package is broken. This stop motion system may be an optical stop motion system of the type presently commercially available which generates a signal applied to the microprocessor as an interrupt signal. This interrupt signal forces the microprocessor to stop current program execution and to immediately implement routines established by the software which appropriately stop the winding process and signal for operator help.

Also, as an additional communication facility to communicate with operators and plant personnel, the microprocessor in the illustrated embodiment is connected to a keyboard and display, indicated at (KB/D) in FIG. 11, and through a communication link CL through a RS 485 serial transmission line to a host computer. The onboard communications provided to the display and keyboard section KB/D allow the microprocessor MP to relate the machine status to the operator and to receive operator request for activity. The communications link line allows the microprocessor to acquire all operations data, such as yarn speed, max yardage, max diameter, pitch, down pressure, etc. that plant personnel may have programmed into a host computer.

Figure 12:
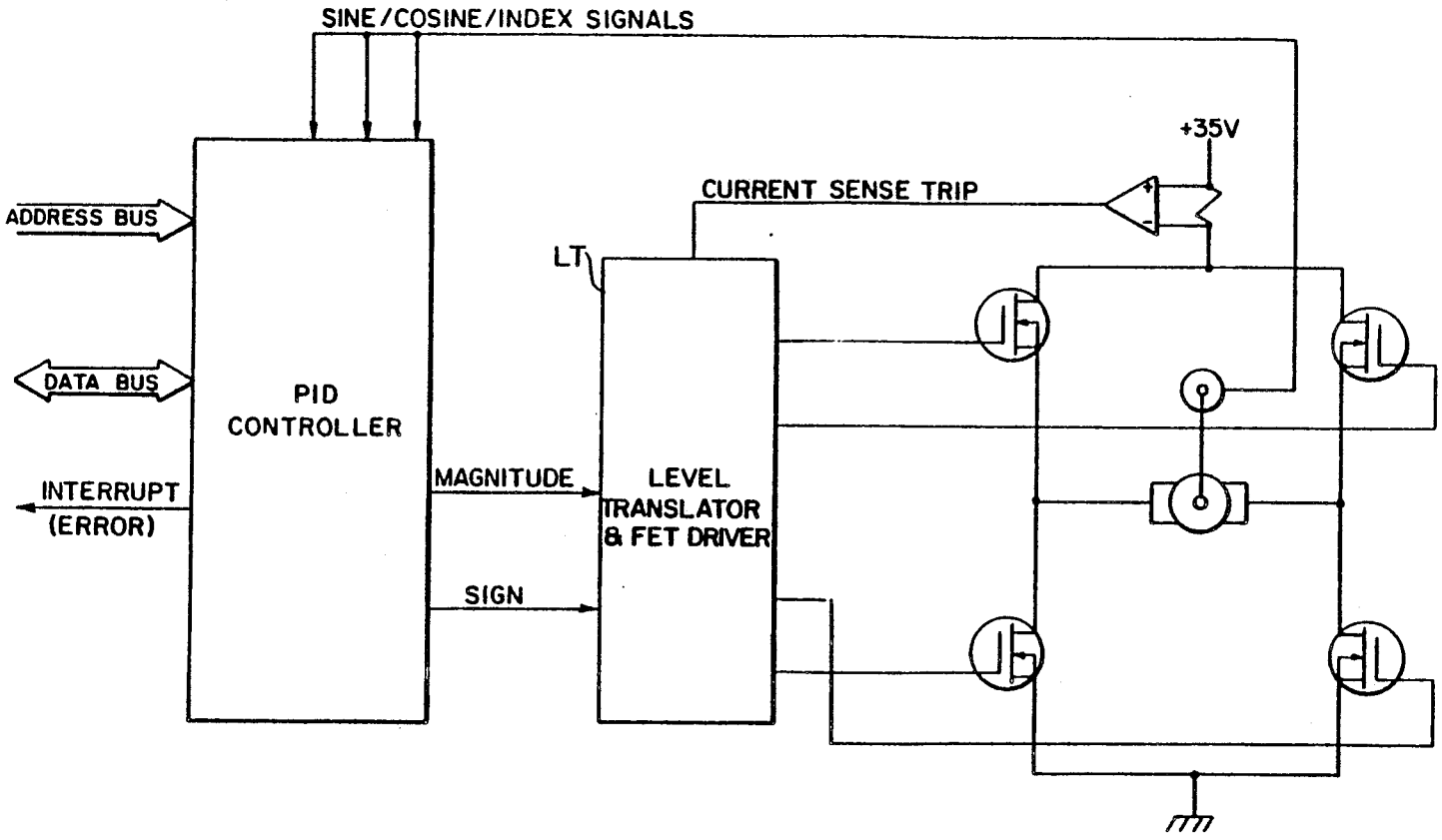
FIG. 12 is a block diagram of a typical proportional, integral derivative (PID) motor control section for the winder control system.

Referring now to FIG. 12, there is shown in block diagram form an example of the motor control section MS of the illustrated embodiment, comprising a digital subsystem which receives data from the microprocessor MP and from the motor shaft encoder and is designed to be a real time proportional integral, derivative (PID) controller. The microprocessor write data to the PID controller to establish acceleration rates, velocity, position, error limits, system gain, etc., of the associated motor, either the spindle motor 29, the propeller motor 66, or the carriage motor 72. It will be understood that such a typical motor control section as here described is provided for each of these three motors. The shaft encoder information (sine/cosine/index signals) generate feedback data to the PID controller as the motor velocity and position. The output of the PID controller is a pulse width modulated (PWM) signal which varies from 0 to 100% "ON" to the motor driver, full ON or 100% PWM corresponding to the max speed and/or torque of the DC motor system. PID controllers calculate what encoder signals should be, based on command data from the microprocessor MP and the specialized filter parameters inherent to this type control. Deviations between actual (encoder) and calculated (command) data are monitored to see if they exceed programmed limits. If these limits are exceeded, an error signal is generated to the microprocessor MP for further action. For example, if the motor shaft is locked and the microprocessor MP requests a speed of 100 rpm, the PID controller will see a speed error as the shaft is not turning. The microprocessor MP will respond to this error by cancelling the speed command and alerting the operator to a problem with this motor. A level translator and FET driver section, indicated at LT, is provided to convert the PID pulse width modulated signal to a power signal of the same duty cycle which will drive the FET's. The current sense assures that neither motor nor FET's will be over-currented and thus damaged. This also provides for torque control of the motor.

Figure 13:
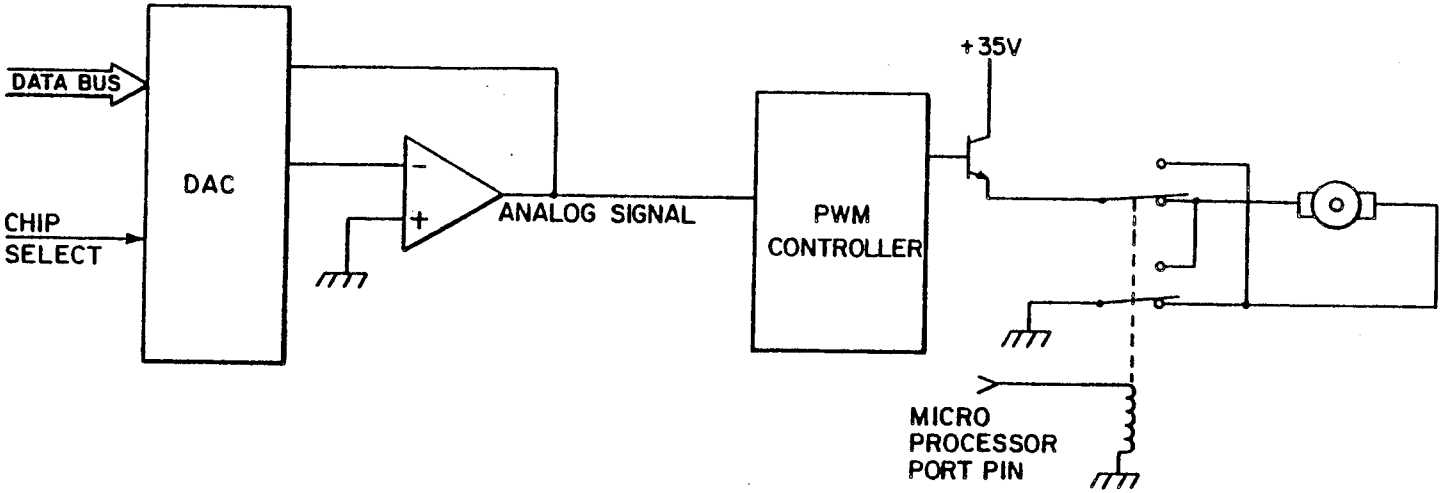
FIG. 13 is a block diagram of a typical Digital to Analog Converter (DAC) section for the winder control system.

FIG. 13 shows in block diagram form a typical Digital to Analog convertor (DAC) section such as the sections indicated at D/A in FIG. 11. The Digital to Analog converter DAC accepts digital information form the microprocessor MP and converts to an analog signal. This particular DAC is an 8 bit; 0–5 vdc device. This means that the resolution of the output is 1 in 255 or 0.0196 V per bit. Mid scale would be 128 or $128 \times 0.0196$ equal 2.5 vdc. This analog signal controls a Pulse Width Modulator (PWM): 0 vdc-0% duty cycle, 5 vdc equal 100% duty cycle. Consequently, the microprocessor MP may control the Pulse Width Modulator duty cycle to the doff motor 39. In this case, the current is controlled by the PWM. If 50% of the motor torque is required to seat the package tube holder 17, the microprocessor will command 128 to the DAC in the direction so that the plunger moves out toward the package tube. To retract the tube holder, the microprocessor will command 60% torque in the opposite direction. Direction is controlled by the microprocessor via the relay.

To summarize the, sensed signals and the control signals for the winder control system include the following:

SENSED "SIGNALS"

Load Cells 0.5 V from Bail Roller represents 0–53 lbs. force (to A/D)

0.5 V from Tensiometer represents 0–125 grams (to A/D)

Other 0.5 VDC represents 0–25 ma in Tensioner—This assures that Tensioner is electrically functional (to A/D).

0–5 VDC represents 0-full current in the doff motor—this allows the microprocessor to assure that the doff motor is functional and to establish the value of the motor Torque (current) (to A/D)

All system power is monitored to be sure that voltages are within specification: +160 vdc, +5 vdc, +15 vdc, 34 vdc.

Stop Motion

A digital level tells the microprocessor if yarn is moving or not. This allows the MP to sense a broken yarn strand during the winding process.

CONTROL "SIGNALS"

To Spindle, Propeller & Overfeed (1) Acceleration
(2) Velocity
(3) Max. position error
(4) proportional gain
(5) derivative gain
(6) integral gain & limit

Carriage Motor (1) all of above
(2) position

Tension (1) digital value to establish tension level (D/A)

Doff Motor (1) Digital values to establish Doff motor torque and direction (D/A)

A summary of the control scheme provided by the winder control system is as follows:

WINDER CONTROL SYSTEM SUMMARY (A) Spindle motor 29, propeller motor 66, and overfeed or carriage motor 72 parameters are derived from operator input and factory settings.

(B) Carriage position of carriage 40 is determined by the Bail roller load cell 48. The pressure setpoint is derived from operator input. Whenever the Bail roller load cell 48 exceeds this setpoint, the carriage 40 is commanded to a new, lower position. The magnitude of the correction is dependent on the magnitude of the load cell signal over the setpoint.

(C) Two levels of tension control are available.

(1) The tension set point is established by operator input. The MP uses the current feedback as a fail safe.

(2) The tension setpoint is established by the operator. The MP sets a value to the tensioner which corresponds to this tension during a static condition. However, when the winder begins to run, the MP reads the Tensiometer load cell 90 and compares this value to the command value. This allows the system to be run as fast as the inlet tension will allow—as the tensioner value could be reduced to OVDC and the delivered tension to the winder would be a summation of supply (inlet) tension, friction and windage.

(D) The Doff motor 39 is a torque (current) controlled device. To assure that the package tube 17 is firmly held, the MP will command a level of torque which corresponds to a certain axial force on the tube. The MP then monitors the current to see when this level is attained. This assures that the package is firmly seated between the two tube holders and that the current can be lowered to a holding value for running. This also allows the MP to select torque values such that the unseating force is always greater than the seating. Thus, a yarn package should never become stuck.

(E) Package, yardage, pitch, yarn speed are derived mathematically $$\text{yds} = \sqrt{\text{circ}^2 + \frac{(\text{length})^2}{\text{pitch}}} / 36 \times \text{Turns}$$

$$\text{pitch} = \frac{2 \text{ spindle rpm}}{\text{propeller rpm}}$$

$$\text{yarn speeds} = \frac{\text{circ}}{36} \times \text{rpm} = \text{yds per minute}$$

(F) Outside diameter of the package is determined by knowing the position of the Bail roller 46. This is accomplished by using the shaft encoder on the carriage motor 72 in conjunction with the PID controller. Resolution is approximately 0.0000167 inches per pulse of position. This allows the MP to calculate circumference.

Figure 10:
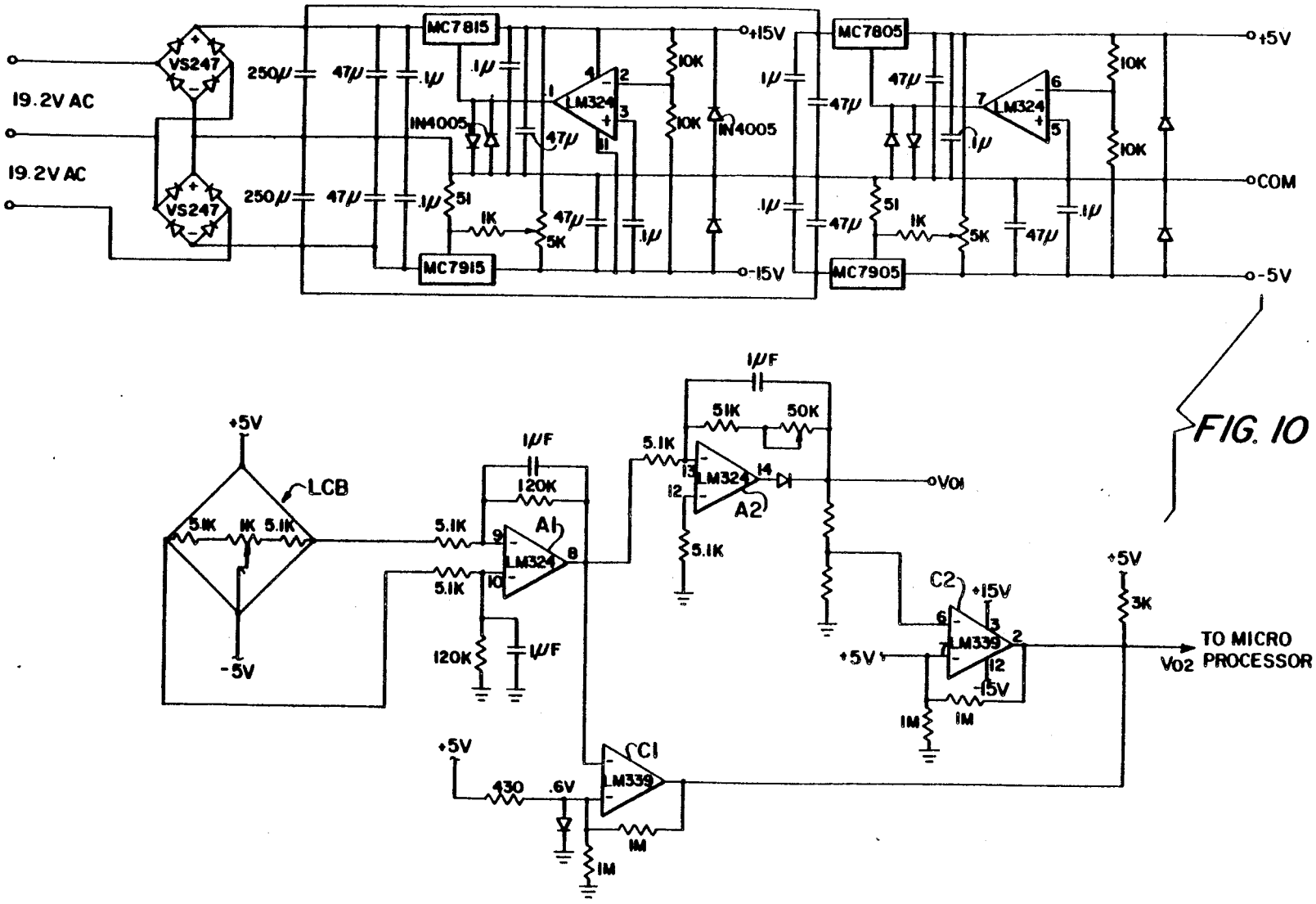
FIG. 10 is a schematic diagram of a typical load cell circuit for processing load cell signals from a load cell associated with one of the sensed conditions in the winder, of the present invention, such as the bail roller load cell.

A typical load cell circuit, for use either with the load cell 40 associated with the bail roller 46, or the load cell 90 associated with the tensiometer 80 is shown in FIG. 10. The upper half of the circuit shown in FIG. 10 is simply power supply. Both supplies are designed to track so as to minimize system error due to un-symmetrical power supplies. Typical load cells sensitivities are 2 MV/V. Consequently, for a 10V supply (+5;−5) the full scale Load cell signal will be 20 MV. This same signal could be provided by a 40 MV drift of one of the power supplies.

The load cell bridge, indicated at LCB, is excited by a +5 V;−5 V power supply for a total of 10 Volts. This also makes the signal lines reference to OVDC—or ½ bridge voltage. This makes for an easy amplifier design which does not require level shifting. The bridge is zeroed by the resistor network across the bridge of 5.1K, 1K values.

The first operational amplifier A1 has a gain of about 24 and a very low frequency response due to the 1 mfd feedback capacitor. This is to attenuate high frequency signals which are primarily due to vibration.

The second operational amplifier A2 is the full scale stage. System gain is set by the 50K feedback pot. For the bail roller load cell 48, OVDC output represents the weight of the bail roller 46 and bearings—as these effects are purposely zeroed out. A full scale of 5 VDC represents about 53 pounds of force on the bail roller 46.

The two LM339 comparators C1 and C2 are used as error detectors. These devices are designed so that if the load cell goes negative by more than 0.6 V or goes beyond +5 VDC the microprocessor MP is sent an error signal. The MP can then stop the process and alert the operator.

Another version of the high speed precision yarn winding apparatus is shown in FIGS. 14–19, wherein the vertical translating subframe 40 carrying the yarn guide blades or propellers **50*a*, 50*b* and the bail roll 46 and platform 43, and associated parts, is dispensed with and the propeller drive mechanism and platform therefore are mounted on a stationary portion of the main frame and the tube engaging and supporting subassembly and mounting components are supported on a pair of tiltable or arcuately movable support arms. This arrangement permits achievement of certain economies in manufacture of the high speed precision yarn winding apparatus as a considerable number of the movable parts of the previously described embodiment are now supported from stationary portions of the frame. Referring particularly to FIGS. 14 through 18, the modified version of the precision yarn winding apparatus is generally indicated by the reference character 110 and comprises a stationary supporting frame, the upper portion of which are indicated at 111 and include vertical angle iron frame members 112 and a horizontal top plate 113 fixed to the uppermost ends of the vertical frame members 112. Supported immediately above the top plate 113 is a platform 143, supported at the rear by hinge straps 143*h* mounted to the top plate. Mounted on this stationary platform 143 is the pair of yarn guide blades or propellers 50*a*, 50*b* like the blades shown and described in connection with the first embodiment, which rotate in opposite directions but are positioned immediately above and below the curved yarn guide bar 51 with its convexly curved working edge 52 extending along the curved path between the pair of end control guide rails 53, 54. As described in connection with the first embodiment, the yarn guide propeller blades 50*a*, 50*b* and the stationary yarn guide bar 51 and end control guide rails 53, 54, form a yarn winding station at which the yarn 55 is traversed first from right to left (as viewed in FIG. 15) along the length of the package 118 and then transfers to the guide propeller or blade 50*b* adjacent the end control guide rail 54 and is traversed back to the right hand end as viewed in FIG. 15. The yarn guide bar 51 is this embodiment is located at a vertical level between the planes in which the yarn guide blades 50*a*, 50*b* rotate rather than being below both blades 50*a*, 50*b*, thereby avoiding any differences in the length of the yarn traversal path at the change-over points defined the end control guide rails 53, 54 and guide bar 51. Also, the end control guide rails 53, 54** are preferably made of transparent material to facilitate visual inspection of the region immediately below them.

The driving mechanism for the yarn guide blades, as in the previously described embodiment, comprises a propeller shaft 56 supported for rotation about a vertical axis, which is fixed to the upper yarn guide blade **50*a* and extends through a center opening in the lower guide blade 50*b*. The lower yarn guide blade 50*b* is fixed to an upper pulley member 57 having a center collar portion, like the portion 57*a* in FIG. 5, encircled by roller bearing assemblies 58 whose outer portions are supported in an extension like the extension 59*a* of the bearing housing 59. The lower portion of the bearing housing 59 supports the outer portion of the roller bearing assembly 60 which encircles and is mounted on the spindle portion 61*a* of the lower pulley 61 (see FIG. 5**).

Figure 5:
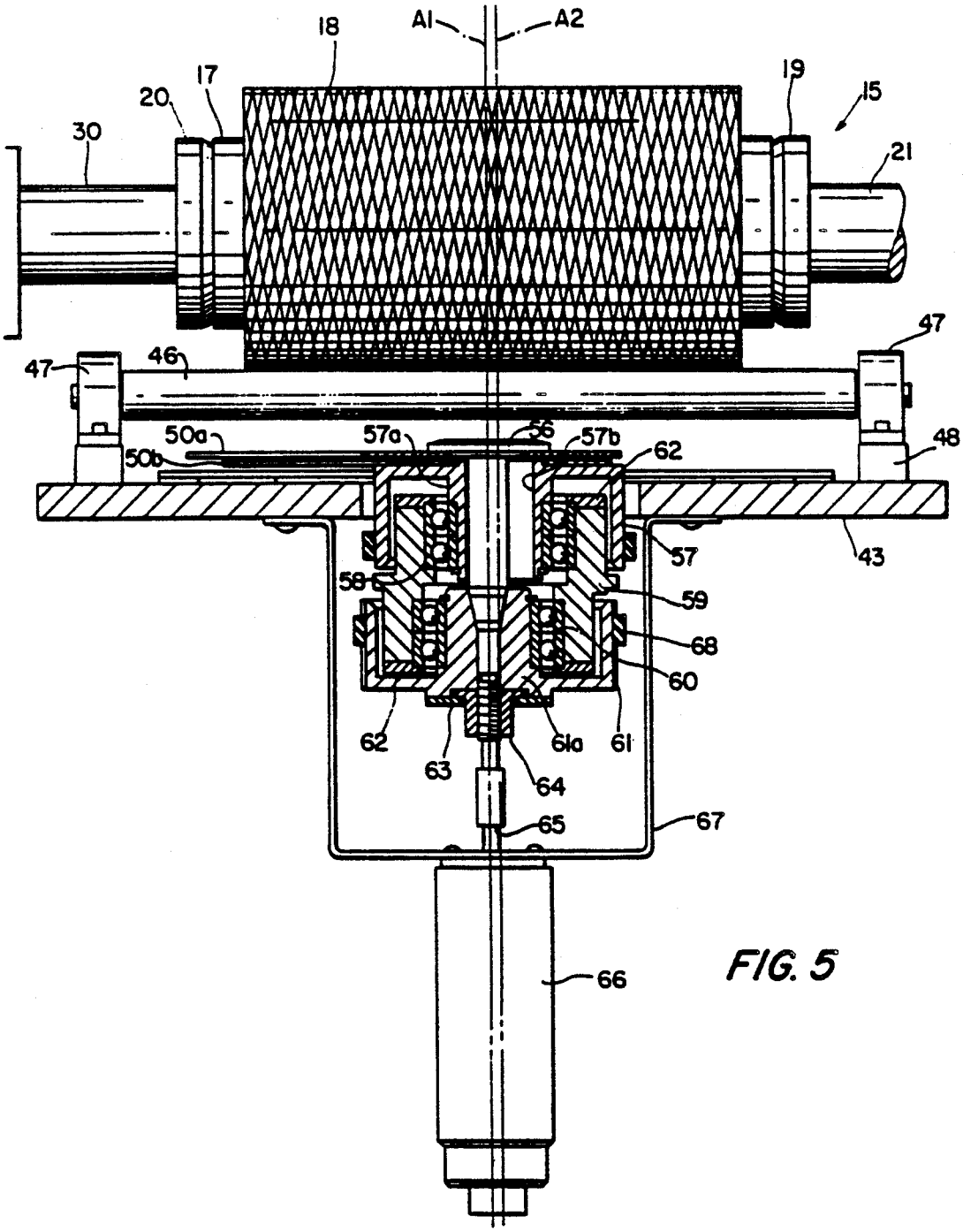
FIG. 5 is a vertical section view showing the bail roll and the yarn guide propeller drive mechanism and drive motor therefor, taken along the line 5—5 of FIG. 4.
Figure 6:
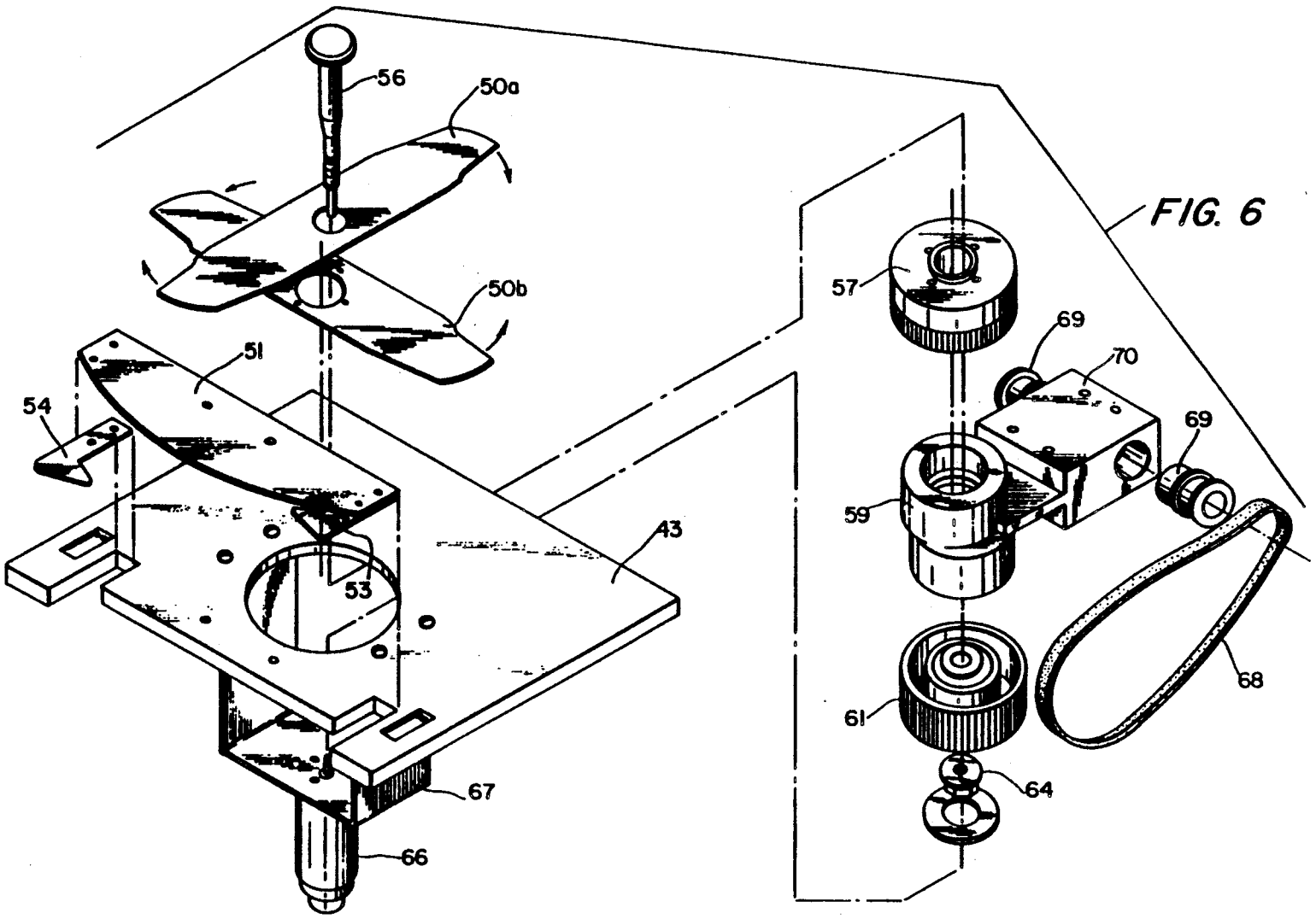
FIG. 6 is an exploded perspective view of the yarn guide propeller mechanism and supporting platform therefor and the associated drive components.

These bearing assemblies 58, 60 are captured in the bearing housing 59 by retainer rings 62 and the upper pulley 57 rotates about an eccentric axis as described in connection with the FIG. 5 embodiment located eccentrically relative to the vertical axis 81 which extends through the centers of the propeller shaft 56 in the lower pulley 61. The lower end of the propeller shaft 56 which drives the upper yarn guide blade 50*a* is fixed against relative rotation in the center post portion 61*a* of the lower pulley 61 and the pulley 61 is coupled by a locking ring 63 and lock nut 64 to the drive shaft 65 of the guide blade drive motor 66, which in this embodiment is mounted against the rear surface of the mounting block 70, which in turn is supported by mounting bracket 70*a* fixed to the platform 143 and to the side of mounting block 70. The outer surfaces of the cylindrical pulleys 57, 58 are provided with teeth interfitted with tooth formations of the toothed endless belt 68 which is trained about the lower pulley 61 and then about the drive pulley 166*a* of the yarn guide blade drive motor 166 at one end thereof and about the idler pulley 166*b* at the other end thereof, and then extends about and is interfitted with the teeth on the outer periphery of the upper pulley 57. By this arrangement, the upper pulley 57 is driven in a reverse direction relative to the lower pulley 61 so that the two yarn guide blades 58, 50*b* are driven in opposite direction.

Also mounted on the platform 143 near its forward end is the bail roll 46 supported in bearing brackets 47, 47*a* at its opposite ends. A load cell 148 carried on the uppermost surface of the top plate 113 is disposed between the upwardly facing surface of the top plate 113 and the bottom surface of the hinged platform 143, near the left hand front corner of platform 143, while a dummy block 148*a* shaped like the load cell and capable of being appropriately flexed is positioned below the opposite front corner of platform 143 between the platform and the top plate 113. The mounting of the bail roll 46 is such that the pressure on the bail roll is transmitted through the journaling posts for the bail roll and through the platform 143 to change the stress on the load cell 148, and the associated processing circuitry receives output signals from the load cell and provides a down pressure sensing and control system as described in connection with the first embodiment, to maintain proper down pressure properties responsive to pressure of the package on the bail roll and, in this embodiment, causing the support mechanism for the tube and package being formed thereon to be raised in a very precise manner maintaining proper package winding. The load cell 148 in this embodiment is like the load cell 48 described in connection with the first embodiment of FIGS. 1–13.

Figure 15:
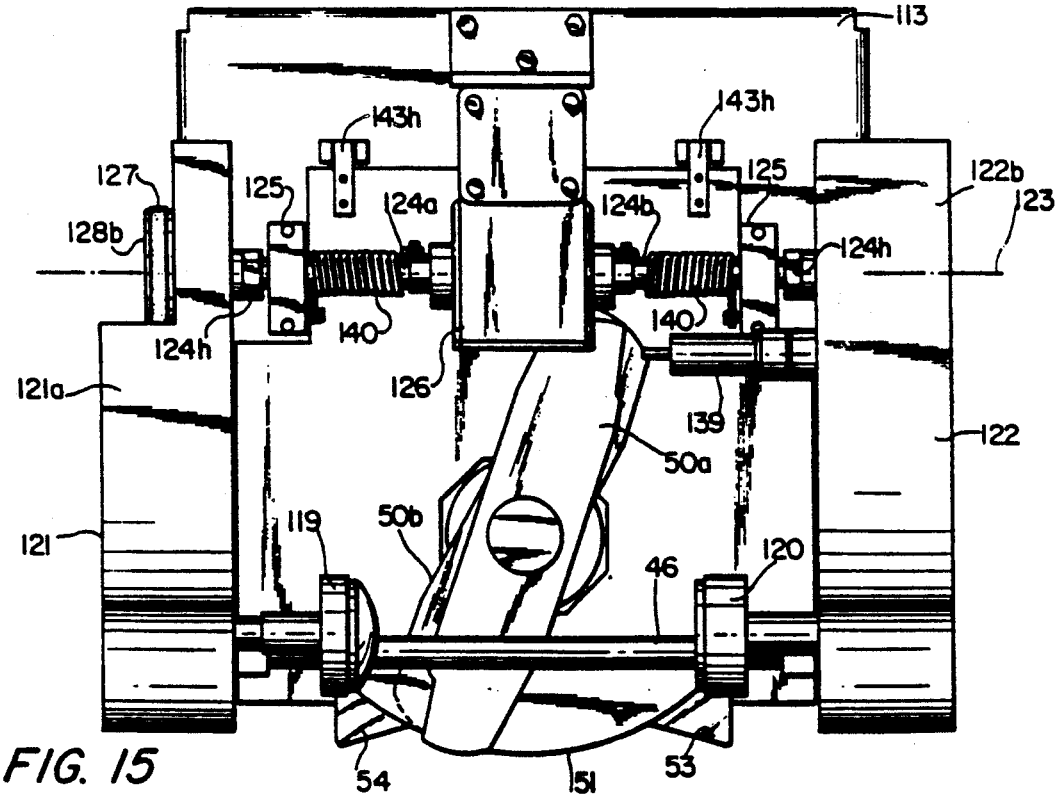
FIG. 15 is a top elevational view of the version shown in FIG. 14.

The driven tube-engaging head subassembly generally indicated at 115 and the doffing mechanism associated therewith is carried by a pair of supporting arms 121, 122 supported for arcuate movement about a pivot axis, indicated at 123 in FIG. 15, defined by a pair of pivot shaft sections 124*a*, 124*b* journaled in upright bearing posts 125 extending upwardly from the top plate 113. The pivot shaft sections 124*a*, 124*b* are fixed at their outer ends to the respective arcuately movable support arms 121, 122, by expansion collar or nut devices 124*h*, such as Finnerman nuts, which are expandable radially outwardly and inwardly to tightly grip the associated shaft section and the opening therefor in support arm, 121, 123. The shaft sections 124*a*, 124*b* are coupled at their innermost ends to the output from a gearbox 126, for example a 30-to-1 gear box, fixed on and extending upright from the platform 113 and driven, at its input, by a retractor motor 126*m* depending below the top plate 113 and aligned vertically with the gear box 126.

Figure 16:
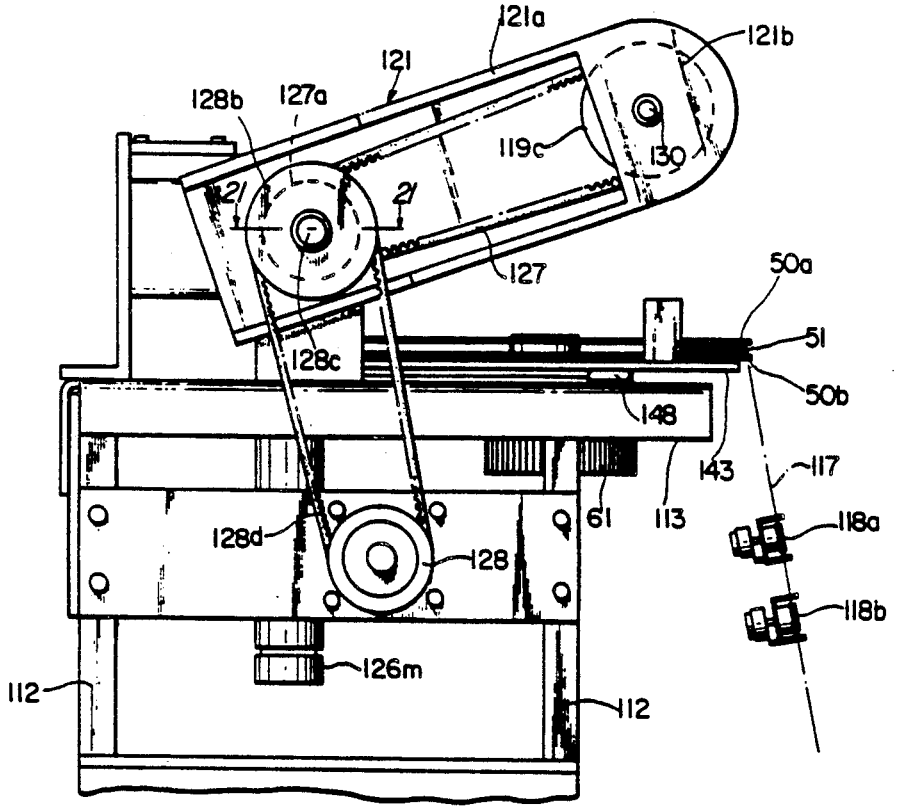
FIG. 16 is a side elevational view of the apparatus viewed from the left of FIG. 15.
Figure 17:
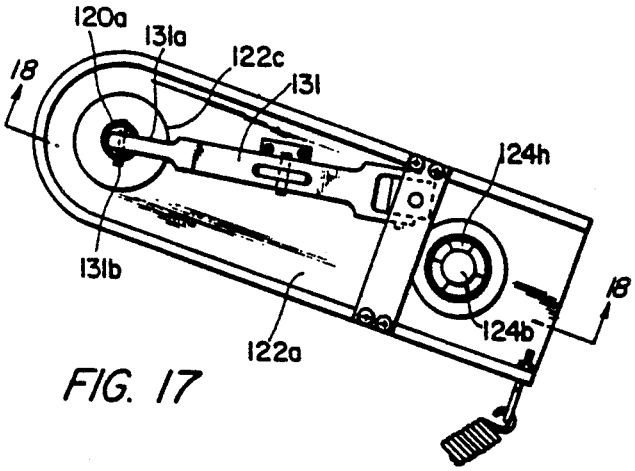
FIG. 17 is a fragmentary side elevational view of the tube supporting lift arm and positioning lever mechanism for the tube engaging head assembly associated with the right hand tube support as viewed in FIG. 15.

Each of the support arms 121, 122 are of substantially U-shaped cross-sectional configuration and include a vertical side wall 121*a* 122*a* and a shroud wall 121*b*, 122*b* projecting outwardly from the vertical side wall and defining an outwardly opening cavity or well within which the associated mechanism is received. The outermost free end portion of the left hand support arm 121 supports a driven tube-engaging head subassembly 115, which in this embodiment includes a driven head 119 having a generally dome shaped convex surface portion 119*a* to engage and protrude into the hollow center portion of the package forming tube 17, and fixed to the end of a drive spindle 119*b*. The other end of the drive spindle 130 is journaled in a wall segment 121*b* of the supporting arm 121 and has a pulley 119*c* fixed thereon, driven by a belt 127 trained about the pulley 119*c* and about a pulley section 127*a* having a companion pulley section 128*b* of a dual pulley rotatable on an eccentric shaft member 128*c* and driven by belt 127 from the output drive pulley 128 on the output shaft of the spindle drive motor 129. The eccentric shaft member 128*c*, as shown in FIG. 16, has two eccentrically offset cylindrical sections 128*c*-1 and 128*c*-2 for the pulley sections 127*a* and 128*a* respectively, and is rotatable in the confronting end portion of an output shaft 124*a* to move the pulley section 127*a* to a release position loosening its belt 127 and permitting removal of the belt when necessary.

The drive motor 129 in this embodiment is a permanent magnet DC servo motor having encoder feedback unit 129*a* associated herewith, such, for example, as a Peerless-Winsmith Model DPMP4MS2 servomotor.

The opposite or right hand arcuately movable support arm 122 supports the doffing mechanism, and comprises the head 120 adapted to engage, and partially interfit in the hollow center portion of, the package supporting tube 17. The head 120 is journaled on the shaft 120*a* by a roller bearing assembly 120*b* and is slidably supported for axial movement in a collar mount formation 122*c* forming part of the side wall 122*a* of the support arm 122. The end of the head supporting shaft 120*a* lying within the arm is pinned to a doff lever 131 having a flattened end portion forming a clevis or loop formation 131*a* extending into a slot or kerf formed in end portion of the shaft 120*a* and pinned thereto by coupling pin 131*b*. The intermediate portion of the doffing lever 131 is provided with a pivot pin support indicated generally at 132 provided by fulcrum post 132*a* projecting from and fixed to the side wall 122*a* of the arm 122 and into a slot in the mid-portion of the lever 131, through which a pin 132*b* extends to define the pivot axis for the lever 131. The other end of the lever is provided with a yoke formation 132*c* which is pinned to a nut member 132*d* threadly coupled to a threaded output shaft 138 having, for example, 15 threads per inch, of a doff motor 139, for example, a DC permanent magnet gear motor having a 5-to-1 ratio head driving the output screw shaft 138. An elongated bar 138*a* fixed at its ends to the upper and lower portions of the shroud-forming wall 122*a* in alignment with the axis of the output screw shaft 138 forms a stop bar for the nut member 132*d* at the tube holding position of the head 120 of the movable head assembly 116.

The 30-to-1 gearbox 126 has a certain amount of inherent backlash. In order to maintain the very high precision positioning of the package supporting tube and the spindle axis relative to the bail roll 46 and the yarn guide blades 50*a*, 50*b*, a preloading spring system is provided on the output shafts from the gear box 126. As shown best in FIGS. 14 and 15, the output shafts 124*a* and 124*b* have torsion springs 140 wrapped around the output shafts 124*a*, 124*b* over most of the lengths of each shaft between the bearings 126*a*, therefor, in the adjacent sides of the gear box 126 and the respective bearing posts 125. The ends of the torsion springs 140 nearest the gear box 126 are anchored to the associated output shaft 124*a*, 124*b*, for example by anchoring pins or similar fasteners, and the opposite or outermost ends of the torsion springs have tangentially projecting end portions, shown at 140*a* in FIG. 14, which bear against a stop pin 125*a* extending from the adjacent bearing post 125, to hold the associated end of the torsion spring against tension releasing movement. In other words, what is being accomplished is the torsion springs 140 hold the backlash out by keeping the associated arms 121, 122 in an upwardly urged position resiliently urging the output gears of the transmission gear box 126 against the back of the associated drive gear or gears with which they are intermeshed.

Figure 14:
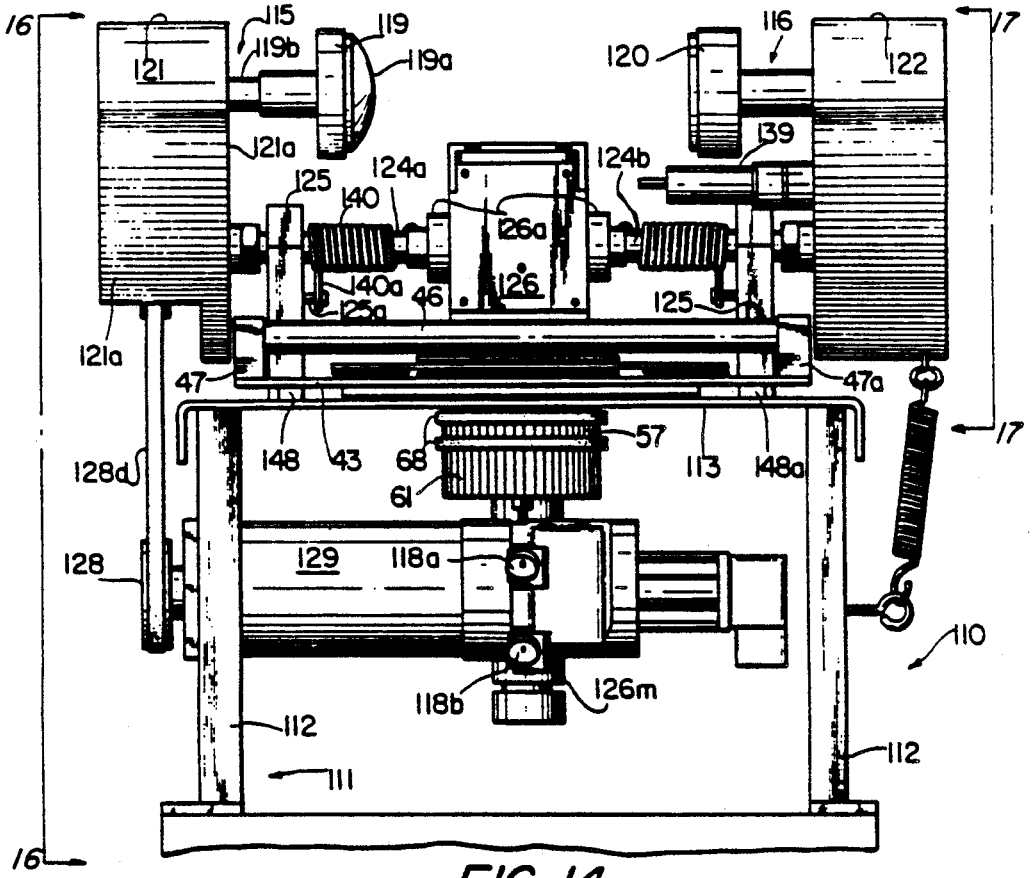
FIG. 14 is a front elevational view of a modified version of the yarn winding apparatus of the present invention wherein the tube supporting mechanism is movable instead of the yarn guide propeller drive mechanism and bale roller assembly, with lower portions of the frame not shown.

Instead of using a load cell type yarn tensioner mechanism of the type shown in FIGS. 7–9 and described in connection with the first preferred embodiment to control infeed yarn tension, the second embodiment preferably employs one or a pair of yarn tension disc mechanism in association with each infeed yarn leading to the yarn guide blades 50*a*, 50*b*. The yarn tension disc units , two of which are shown in FIG. 14 at 180*a* and 180*b* may be of the construction described and shown in FIGS. 8–11 and controlled by circuitry described in connection with FIGS. 7*a*, 7*b* of U.S. Pat. No. 4,313,578 granted Feb. 2, 1987 to the assignee of the present application. Such disc type yarn tension control units includes first and second confronting discs supported for rotation about a shaft protruding from an electric motor through an electromagnetic coil and coupled to one of the confronting discs to continuously rotate it, while the other disc is loosely journaled on the shaft and has a spring finger mechanism correlating movement of the confronting disc in a selected manner to tension yarn passing therebetween.

Thus, in this embodiment of FIGS. 14 through 18, as with the embodiment of FIGS. 1 through 13, the apparatus is provided with three motors providing separate control of three principal factors determining the precision winding of the yarn package so as to provide the desired level of uniformity in absence of ribboning. First, the retractor motor 127 performs functions equivalent to the function of the down pressure control motor 72 of the first embodiment by controlling the vertical position of the spindle axis and therefore of the package forming tube 17, relative to the planes of the yarn guide propellers or blades 50*a*, 50*b* and associated yarn guide structure and the bail roll 46 and its associated load cell 148, all of which are carried at stationary positions on the top plate 113. Secondly, the propeller drive motor 166 carried by the mounting block 70 determines the speed of drive of the yarn guide propellers or blades 50*a*, 50*b* and thus the speed of traverse of the yarn between the opposite ends of the package being formed. Thirdly, the spindle drive motor 129 carried by the stationary main frame drives the spindle 119*a* and driving head 119 to rotate the yarn package tube 17 and thus determine the speed of winding of the yarn onto the package.

Figure 18:
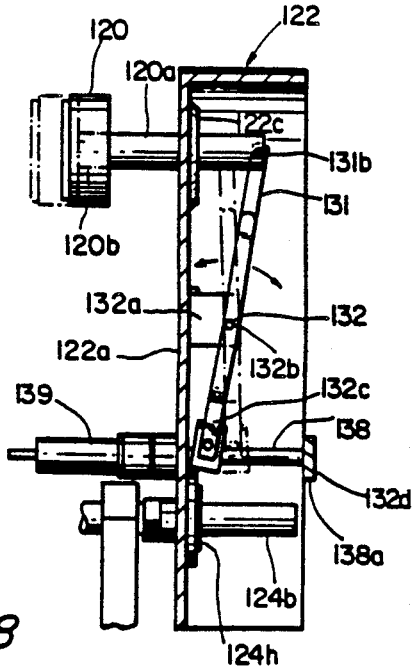
FIG. 18 is a fragmentary section view through the arm of FIG. 17, taken along the line 18—18 of FIG. 17.
Figure 19:
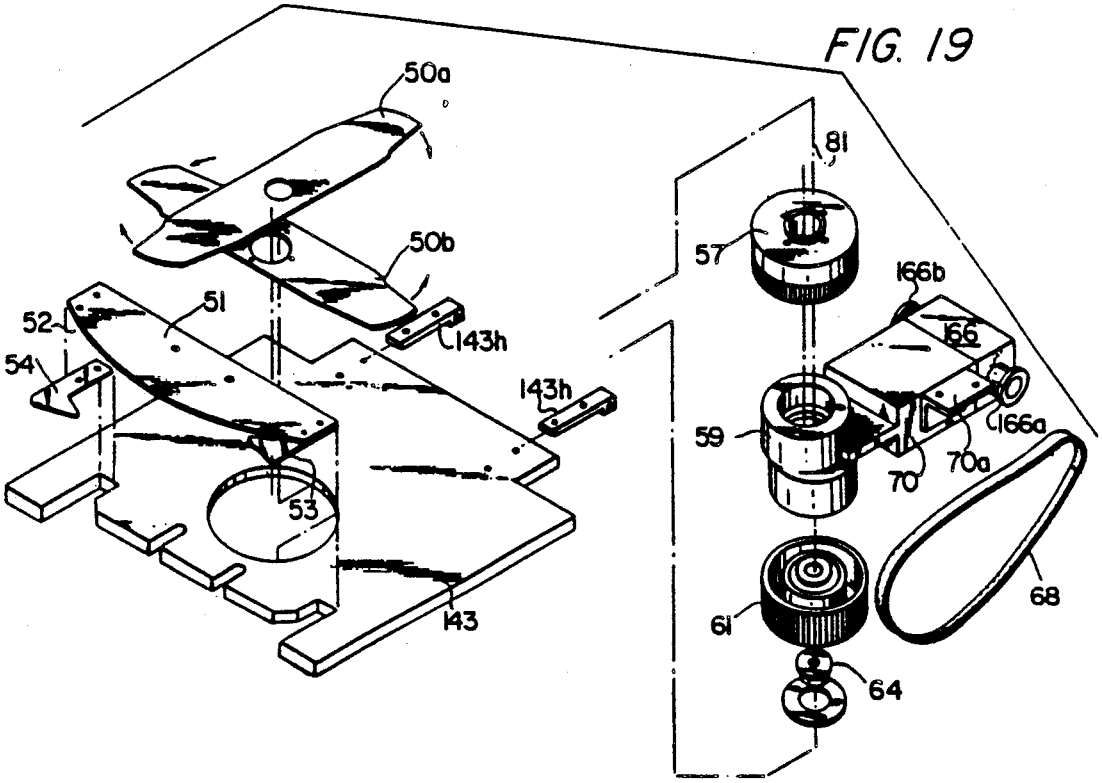
FIG. 19 is a fragmentary exploded perspective view of the drive arrangement for the yarn guide propeller mechanism, and portions of the propellers and associated curved guide bar.
Figure 21:
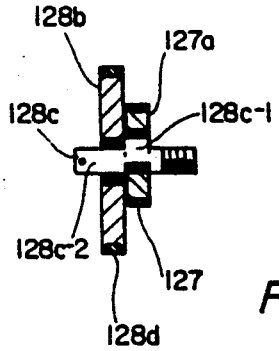
FIG. 21 is a fragmentary section view of parts of the eccentric shaft supporting the intermediate pair of pulleys of the spindle drive.
Figure 20:
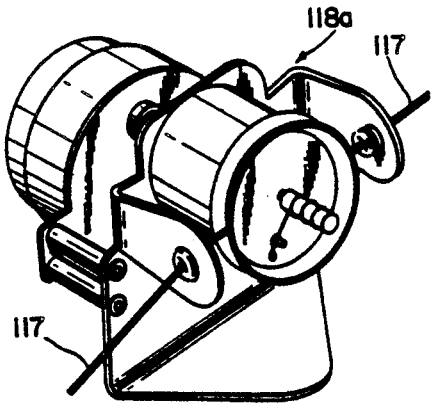
FIG. 20 is a perspective view of one of the infeed yarn tension control devices.

When the microprocessor senses that winding of the yarn package of appropriate diameter is completed, the spindle drive motor 129 and the propeller drive motor 166 are deactivated to terminate the rotary drive to the spindle 119*a* and driving spindle head 119 and to the yarn guide propellers or blades 50*a*, 50*b*, and the retractor motor 126*m* is energized to raise the supporting arms 121, 122 about their pivot axis to a predetermined doff position lifting the package to a position spaced above and out of contact with the bail roll 46, and the doff motor 139 is energized to rotate the threaded output shaft 138 and move the follower nut 132*d* of the doff lever 131 from the broken line position of FIG. 18, which is the normal tube holding position, to the solid line position shown in FIG. 18, which is the doff position, retracting the shaft 120*a* and the head 120 to the solid line position of FIG. 18 where the tube with the yarn package formed thereon can be manually withdrawn and a new tube inserted for commencement of another yarn winding sequence to generate another precision wound package. The pair of tension control disc units 180*a*, 180*b* through its associated control circuitry of U.S. Pat. No. 4,313,578 precisely maintain the infeed yarn tension at the preset value determined by the operator so that there are no infeed yarn tension variations which would act adversely on the precise control achieved by the microprocessor system.

I claim:

1. In a high-speed precision winder for winding a running yarn onto a tube to form a cross wound yarn package, including spindle means for rotating the tube about a spindle axis, yarn traversing means for guiding running yarn received along an infeed path back and forth across a traverse zone adjacent said tube to form the cross wound package, and a bail roll disposed in rolling contact with the peripheral surface of the yarn package being wound; the improvement comprising a down pressure drive, a drive motor, and associated motor control circuit for said down pressure drive, said down pressure drive including down pressure adjusting means for continuously regulating the relative positions of said bail roll and said spindle axis with respect to each other, an upper main frame plate, a platform forming a support for said traversing means and bail roll, a pair of supporting arms fixed to pivot shaft members for arcuate movement about a horizontal pivot axis spaced above said plate and platform, a pair of upright bearing posts extending from said plate journalling said pivot shaft members for rotation, a reduction gearbox having a pair of opposite outputs coupled to said pivot shaft members for rotating the pivot shaft members and the supporting arms fixed thereto about said horizontal pivot axis from a lower start position upwardly through increasing angles to a raised doff position, said drive motor forming a retractor motor for driving the gearbox, bail roll supports carried by said platform for supporting said bail roll, a load cell forming the support structure for a portion of the platform beneath said bail roll for responding to variations in pressure thereon and producing load cell output signals, said load cell continuously sensing package down pressure on the bail roll and platform for producing said down pressure status signals and including means responsive thereto for generating activation and speed control signals for said retractor motor to vary the angular position of said support arms above said bail roll and traversing means on said platform for controlling the vertical position of the tube being driven by said spindle means.

2. A high speed precision yarn winder as defined in claim 1, including a doff motor carried by one of said supporting arms adjacent said horizontal pivot axis, said spindle means including a spindle drive head on the other supporting arm, a live center head carried by the one supporting arm adjacent the free end thereof remote from said pivot axis mounted for reciprocative movement along the spindle axis for releasably receiving and holding a package tube between said live center head and said spindle drive head in driven engagement with the latter, and an elongated doff lever pivotally carried by said one supporting arm near the midportion of the lever having a first end pivotally coupled to said live center head and a second end coupled by a drive mechanism to said doff motor for retracting the live center head to a release position for removal of the package tube and for projecting the same to a tube holding position relative to the spindle drive head, and a motor control circuit for said doff motor for activating the same to retract and project the end of the doff lever coupled thereto and effect retraction and projection of the live center head between said tube holding and tube release positions upon completion of winding of a yarn package.

3. A high speed precision yarn winder as defined in claim 1 wherein said platform has hinge devices adjacent a rear edge thereof hingedly supporting the platform on said plate, said platform having front corner portions at opposite front sides thereof, said bail roll supports for opposite ends of the bail roll being located at said front corners, said load cell being positioned beneath one of said front corners between said platform and plate, and a deformable dummy support block shaped similar to the load cell located beneath the other front corner of the platform.

4. A high speed precision yarn winder as defined in claim 2 wherein said platform has hinge devices adjacent a rear edge thereof hingedly supporting the platform on said plate, said platform having front corner portions at opposite front sides thereof, said bail roll supports for opposite ends of the bail roll being located at said front corners, said load cell being positioned beneath one of said front corners between said platform and plate, and a deformable dummy support block shaped similar to the load cell located beneath the other front corner of the platform.

5. A high speed precision yarn winder as defined in claim 1, including an anti-backlash preloading coil spring encircling each of said pivot shaft members respectively, each anti-backlash coil spring having one end anchored against relative movement to its associated pivot shaft member and having its other end held against a stationary stop maintaining the anti-backlash coil springs stressed to a preselected level to continuously urge the supporting arms upwardly and biasing the gear teeth of the gears in said gearbox in a predetermined direction against the teeth of gears intermeshed therewith under continuous load.

6. A high speed precision yarn winder as defined in claim 2, including an anti-backlash preloading coil spring encircling each of said pivot shaft members respectively, each anti-backlash coil spring having one end anchored against relative movement to its associated pivot shaft member and having its other end held against a stationary stop maintaining the anti-backlash coil springs stressed to a preselected level to continuously urge the supporting arms upwardly and biasing the gear teeth of the gears in said gearbox in a predetermined direction against the teeth of gears intermeshed therewith under continuous load.

7. A high speed precision yarn winder as defined in claim 3, including an anti-backlash preloading coil spring encircling each of said pivot shaft members respectively, each anti-backlash coil spring having one end anchored against relative movement to its associated pivot shaft member and having its other end held against a stationary stop maintaining the anti-backlash coil springs stressed to a preselected level to continuously urge the supporting arms upwardly and biasing the gear teeth of the gears in said gearbox in a predetermined direction against the teeth of gears intermeshed therewith under continuous load.

8. A high speed precision yarn winder as defined in claim 4, including an anti-backlash preloading coil spring encircling each of said pivot shaft members respectively, each anti-backlash coil spring having one end anchored against relative movement to its associated pivot shaft member and having its other end held against a stationary stop maintaining the anti-backlash coil springs stressed to a preselected level to continuously urge the supporting arms upwardly and biasing the gear teeth of the gears in said gearbox in a predetermined direction against the teeth of gears intermeshed therewith under continuous load.

9. A high speed precision yarn winder as defined in claim 2, wherein said supporting arms are each elongated members of laterally outwardly opening channel shape having a U-shaped cross-section defining a channel cavity along most of the length thereof opening toward a respective side of the winder, said doff lever and the end coupling portions thereof being wholly received within the channel cavity of one of said supporting arms and the other of said supporting arms housing in the channel cavity thereof pulleys and pulley belt portions forming part of a drive train from said first drive motor to said spindle drive head.

10. A high speed precision yarn winder as defined in claim 4, wherein said supporting arms are each elongated members of laterally outwardly opening channel shape having a U-shaped cross-section defining a channel cavity along most of the length thereof opening toward a respective side of the winder, said doff lever and the end coupling portions thereof being wholly received within the channel cavity of one of said supporting arms and the other of said supporting arms housing in the channel cavity thereof pulleys and pulley belt portions forming part of a drive train from said first drive motor to said spindle drive head.

11. A high speed precision yarn winder as defined in claim 6, wherein said supporting arms are each elongated members of laterally outwardly opening channel shape having a U-shaped cross-section defining a channel cavity along most of the length thereof opening toward a respective side of the winder, said doff lever and the end coupling portions thereof being wholly received within the channel cavity of one of said supporting arms and the other of said supporting arms housing in the channel cavity thereof pulleys and pulley belt portions forming part of a drive train from said first drive motor to said spindle drive head.

12. A high speed precision yarn winder as defined in claim 8, wherein said supporting arms are each elongated members of laterally outwardly opening channel shape having a U-shaped cross-section defining a channel cavity along most of the length thereof opening toward a respective side of the winder, said doff lever and the end coupling portions thereof being wholly received within the channel cavity of one of said supporting arms and the other of said supporting arms housing in the channel cavity thereof pulleys and pulley belt portions forming part of a drive train from said first drive motor to said spindle drive head.

13. A high-speed precision winder for winding a running yarn onto a tube to form a cross wound yarn package, including a spindle assembly for rotating the tube about a spindle axis, a yarn traversing mechanism for guiding running yarn received along an infeed path back and forth across a traverse zone adjacent said tube to form the cross wound package, a bail roll disposed in rolling contact with the peripheral surface of the yarn package being wound; a supporting assembly for said spindle assembly and traversing mechanism and bail roll comprising an upper main frame plate, a platform forming a support for said traversing mechanism and bail roll, a pair of supporting arms fixed to pivot shaft members for arcuate movement about a horizontal pivot axis spaced above said plate and platform, a pair of upright bearing posts extending from said plate journalling said pivot shaft members for rotations, a reduction gearbox having a pair of opposite outposts coupled to said pivot shaft members for rotating the pivot shaft members and the support arms fixed thereto about said horizontal pivot axis from a lower start position upwardly through increasing angles to a raised doff position, a retractor motor for driving the reduction gearbox, bail roll supports carried by said platform for supporting said bail roll, and a load cell forming the support structure for a portion of the platform beneath said bail roll for responding to variations in pressure thereon and producing load cell output signals.

14. A high speed precision yarn winder as defined in claim 13 wherein said platform has hinge devices adjacent a rear edge thereof hingedly supporting the platform on said plate, said platform having front corner portions at opposite front sides thereof, said bail roll supports for opposite ends of the bail roll being located at said front corners, said load cell being positioned beneath one of said front corners between said platform and plate, and a deformable dummy support block shaped similar to the load cell located beneath the other front corner of the platform.

15. A high speed precision yarn winder as defined in claim 13, including an anti-backlash preloading coil spring encircling each of said pivot shaft members respectively, each anti-backlash coil spring having one end anchored against relative movement to its associated pivot shaft member and having its other end held against a stationary stop maintaining the anti-backlash coil springs stressed to a preselected level to continuously urge the supporting arms upwardly and biasing the gear teeth of the gears in said gearbox in a predetermined direction against the teeth of gears intermeshed therewith under continuous load.

16. A high speed precision yarn winder as defined in claim 13 wherein said supporting arms are each elongated members of laterally outwardly opening channel shape having a U-shaped cross-section defining a channel cavity along most of the length thereof opening toward a respective side of the winder, said doff lever and the end coupling portions thereof being wholly received within the channel cavity of one of said supporting arms and the other of said supporting arms housing in the channel cavity thereof pulleys and pulley belt portions forming part of a drive train to spindle assembly.

* * * * *